United States Patent [19]

Heine

[11] Patent Number: 4,664,365

[45] Date of Patent: May 12, 1987

[54] VISE

[75] Inventor: Werner Heine, Ermengerst, Fed. Rep. of Germany

[73] Assignee: George Kesel GmbH & Co. KG, Fed. Rep. of Germany

[21] Appl. No.: 901,411

[22] Filed: Aug. 28, 1986

[30] Foreign Application Priority Data

Sep. 12, 1985 [DE] Fed. Rep. of Germany ..... 3532490

[51] Int. Cl.[4] ..... B25B 1/10

[52] U.S. Cl. ..... 269/246; 269/285; 269/329

[58] Field of Search ..... 269/101, 216, 246, 250, 269/285, 329; 81/467, 479

[56] References Cited

U.S. PATENT DOCUMENTS

| | | | |
|---|---|---|---|
| 2,882,656 | 4/1959 | Novkov | 269/289 |
| 2,889,729 | 6/1959 | Orner | 81/467 |
| 3,312,461 | 4/1967 | Copron | 269/246 |
| 4,295,641 | 10/1981 | Boucher | 269/285 |
| 4,328,709 | 5/1982 | Schramm | 81/479 |
| 4,569,509 | 2/1986 | Good | 269/246 |
| 4,602,538 | 7/1986 | Neuhaus | 81/467 |

FOREIGN PATENT DOCUMENTS

| | | | |
|---|---|---|---|
| 55-65043 | 5/1980 | Japan | 269/246 |

*Primary Examiner*—Robert C. Watson
*Attorney, Agent, or Firm*—Angelo Notaro

[57] ABSTRACT

At a base of a vise a U-shaped tie element is floatingly mounted in such way that a front leg portion thereof abuts aginst the rear inner face of a stationary clamping jaw. The area of contact between the front leg portion and the clamping jaw comprises the combination of a convex nose at the one part and a planar face at the other part. The tie element is supported by resilient means which are separated from the contact area. Thereby the tie element is self-adjusting and a uniform contact is gained along the whole width of the tie element. During clamping the front leg portion is pivoted with respect to the base section of the tie element, however, thanks to a rolling line contact at the stationary clamping jaw no forces are transmitted which would angularly displace the stationary clamping jaw.

13 Claims, 13 Drawing Figures

VISE

BACKGROUND OF THE INVENTION

1. Field of the Invention

The present invention relates to a vise, which is mounted on the bed of a milling or grinding machine thereby to fix a work in position.

2. Description of the Prior Art

A usual vise is made to have its one clamping jaw fixed to the base thereof and its other clamping jaw made movable toward and away from the stationary clamping jaw by means of a threaded spindle. Especially in high-pressure vises the stationary clamping jaw tends to become yielded because the base of the vise is bent upwards. In order to avoid such bending of the vise base, which apparently will prevent accurate 90°-surfaces of the work piece a separate U-shaped tie element has been proposed in U.S. Pat. No. 2,882,656. The front leg portion of the tie element is pivotably mounted at the stationary clamping jaw by means of laterally projecting pins which are supported in arcuate recesses of the stationary clamping jaw. The rear leg portion of the tie element has a thread hole for engagement with the threaded spindle. When a work piece is clamped between the jaws the tie element is deformed however, the base is relieved from reaction forces and the stationary clamping jaw remains in its vertical position.

In the known vise the lateral pins indeed provide for a swivelling mounting of the tie element however, the whole reaction forces of the clamping forces are transmitted to the pins which in case of high-pressure vises would become distorted. Furthermore, it is necessary to have both pins precisely aligned in order to prevent that the pins are non-uniformly loaded. In practice this would result in high production costs. Last but not least the pivot axis of the tie element should have a maximum distance from the base in order to prevent that the stationary clamping jaw becomes yielded. If large dimensioned pins are used which are required with high-pressure vises the pivot axis necessarily comes nearer to the base and in fact would lie on a level within the lower half of the clamping jaw.

From German Patent No. 30 00 162 a similar vise is known which however has the disadvantage that the front leg portion of the U-shaped tie rod has a planar upper end face which contacts a complementary inner face of the stationary clamping jaw and is fastened thereto by a pair of screw bolts. Because of the rigid connection between the tie element and the stationary clamping jaw the latter becomes tilted by distorsion of the tie element when high clamping forces are applied. Therefore, a precise squaring of a work piece is not possible.

SUMMARY OF THE INVENTION

It is, therefore an object of the invention to provide a vise which can clamp a work piece with a high clamping force without fail.

Another object of the invention is to provide a high-pressure vise which can be economically produced, but nevertheless avoids any distorsions of the stationary clamping jaw.

Another object of the invention is to provide a vise, in which the force transmitting area between the front leg portion and the stationary clamping jaw on the one hand and the supporting means for the tie element on the other hand are separated from one another.

Still another object of the invention is to provide a high-pressure vise which even allows to eccentrically clamp a work piece without distorsion of the stationary clamping jaw.

According to the present invention a vise is provided comprising the crosswise axis for pivoting the front leg portion of the tie element arranged at an end face of the front leg portion, the end face facing the stationary clamping jaw, a substantial line-shaped contact area provided between the end face of the front leg portion and an adjacent inner face of the stationary clamping jaw and extending in crosswise direction substantially along the whole width of the front leg portion, and float mounting means mounting the tie element in a selfaligning manner for a swinging motion about a vertical axis intersecting the central point of the contact area at half of the width of the front leg portion.

Thanks to the float mounting concept the tie element can adjust itself so that reaction forces are uniformly absorbed along the whole length of the contact area even if a work piece is eccentrically clamped. Inspite of lower cost of production the clamping yaws remain in an absolute parallelity even in a high-load condition.

DESCRIPTION OF THE PREFERRED EMBODIMENTS

Figure 2:
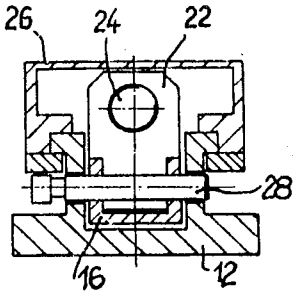
FIG. 2 is a cross-section of a vise taken along line 2—2 of FIG. 1.

A vise 10 comprises a base 12 in the form of a housing, a stationary clamping jaw 14 integrally formed therewith, a float-mounted U-shaped tie element composed of a base section 20 integrally formed with a front leg portion 18, a rear leg portion 22 which forms a separate body, rides on the base section 20 and can be fixed thereon in different longitudinal positions by cross bolts 28, a threaded spindle 24 projecting through a thread hole of the rear leg portion 22 and abutting against a movable clamping jaw 26, which is displaceably guided at longitudinal rails of the base 12.

A pair of laterally aligned recesses 30 are provided in side faces of the front leg portion 18. Cross bores 32 are coaxially arranged in side walls of the stationary clamping jaw 14. In each cross bore 32 a pin 34 provided with a ball-shaped end is arranged together with a spring 36 and threaded piece 38 screwed into a threaded section of the cross bore 32. By means of the spring-loaded pins 34 which project into the recesses 30 the tie element 16 is floatingly mounted. The recesses 30 have a concave ball-shaped inner surface respectively, the diameter of which is greater than that of the ball-shaped end of each pin 34. Therefore, the pins 34 tend to hold the axes of the recesses laterally aligned with the axes of pins 34 however allow a sufficient displacement of the side faces of the front leg portion 18 with respect to the side faces of the stationary clamping jaw 14 to get a self-adjusting effect of the tie element 16.

Figure 3:
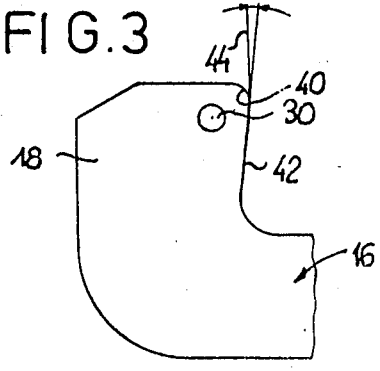
FIG. 3 is an elevational view of a front leg portion of a U-shaped tie element in a larger scale.

A planar end face 42 of the front leg portion 18 facing the stationary clamping jaw 14 is inclined with respect to a planar inner face 46 (see FIG. 8) of the stationary clamping jaw 14 which extends in a vertical cross plane marked by numeral 44 in FIG. 3. The angle between the end face 42 and the inner face 46 is in the order of 5°. A gap 48 is formed between the end face 42 and the inner face 46 the width of which increases continuously in downward direction. The crosswise-extending upper edge between the end face 42 and the upper face of the front leg portion 18 is rounded along its whole length to form a convex nose 40 which contacts the inner face 46 of the stationary clamping jaw 14 along its whole length, when the axes of pins 34 and recesses 30 are laterally aligned. However, it is not necessary to manufacture the parts with high precision because when applying a clamping force to the stationary clamping jaw 14 the tie element 16 will adjust itself in such way that the pins 34 will be displaced in the recesses by small amounts resulting in a continuous contact area between the nose 40 and the inner face 46 substantially theoretically along a lateral line. This contact line forms a pivot axis for the front leg portion 18 when the tie element is elastically deformed by the clamping force. During the clamping operation a rolling line contact is maintained between the nose 40 and the inner face 46 resulting in a small downward displacement of the contact line.

The front leg portion 18 of the tie element 16 is of solid construction. The base section 20 has a U-shaped cross-section of the same constant width. Both sections form an integral swage unit. It is important that the base section 20 of the tie element 16 is not fastened at the base 12 of the vise, in order to prevent that bending loads are transferred to the bottom of the base. Therefore, the end of the base section 20 of the tie element is free to move along the base 12 upon resilient deformation of the tie element 16. The tie element 16 is spaced from the bottom of the base 12 by a spring-loaded pin arranged in the bottom wall of the base 12 near the end of the tie element 16. Thereby the tie element 16 is mounted at the base 12 and the stationary clamping jaw 14 by a three-point suspension.

Figure 4:
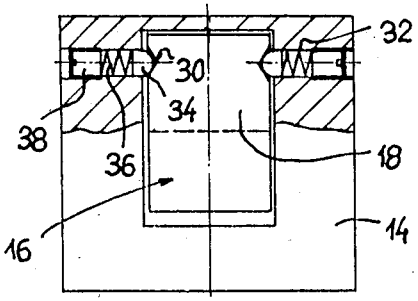
FIG. 4 is a cross-sectional view of a mounting of the tie element on the base.

It should be clear, that instead of the arrangement according to FIG. 4 the spring-loaded pins 34 can be arranged in a cross bore of the front leg portion 18 provided that the recesses 30 are formed in the side walls of the stationary clamping jaw 14.

Figure 5:
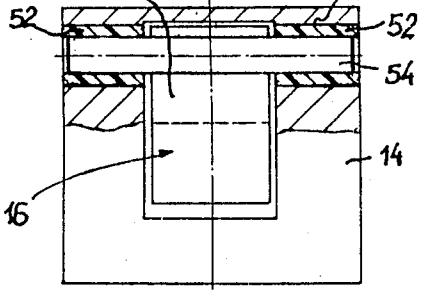
FIG. 5 is a cross-sectional view of a second embodiment of a mounting of the tie element.
Figure 1:
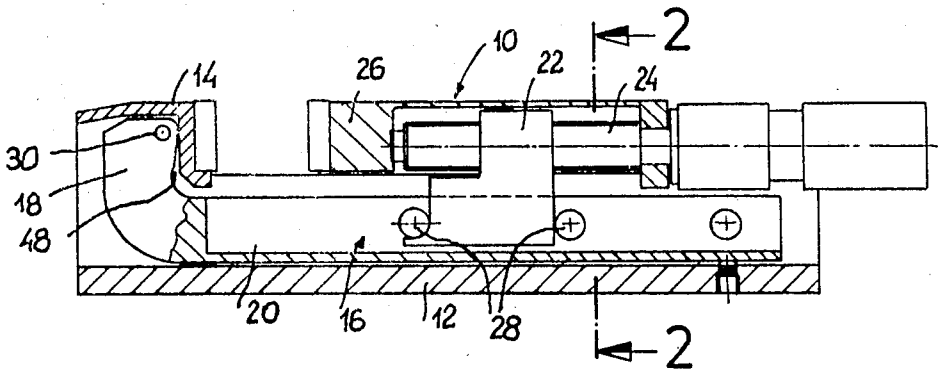
FIG. 1 is a schematic longitudinal section of a vise.

FIG. 5 shows an alternative construction for a float mounting of the tie element 16. Coaxial cross bores 50 are formed in the side walls of the stationary clamping jaw 14. Sleeves 52 of elastic compressible material as for example synthetic rubber are inserted in the cross bores 50. The front leg portion 18 has a through-hole coaxially arranged with respect to the cross bores 50 and having a diameter equal with the inner diameter of the sleeves 52. A stem 54 extending through the through-hole and the sleeves 52 mounts the front leg portion 18 of the tie element floatingly. It should be pointed out that the stem 54 need only be thin, because it is completely relieved from any clamping forces. Alternatively the elastic sleeves 52 instead of being inserted into the side walls of the stationary clamping jaw 14 could be arranged in the front leg portion 18.

Figure 7:
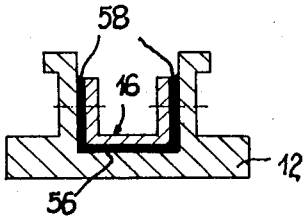
FIG. 7 is a cross-section taken along line 7—7 of FIG. 6.
Figure 6:
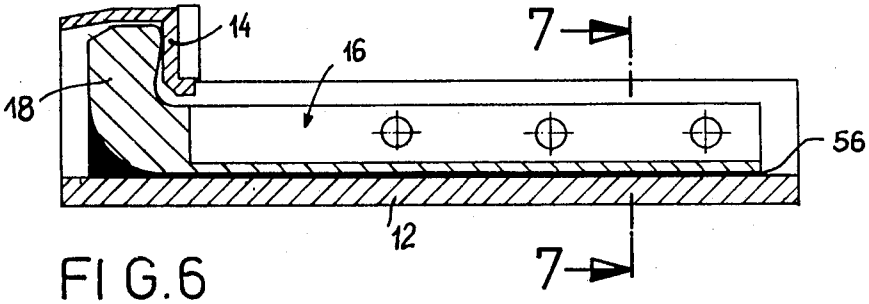
FIG. 6 is a longitudinal section of a tie element which is mounted on the base by embedding it in an elastic deformable plastic material.
Figure 8:
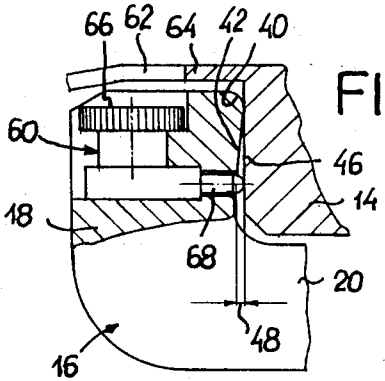
FIG. 8 is a longitudinal section of a tie element having a pressure sensitive device.
Figure 13:
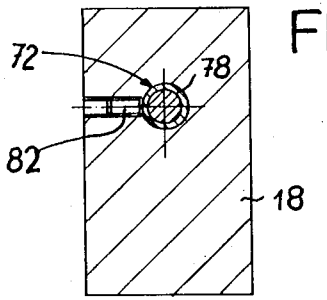
FIG. 13 is a cross-section along lines 13—13 in FIGS. 11 and 12.
Figure 10:
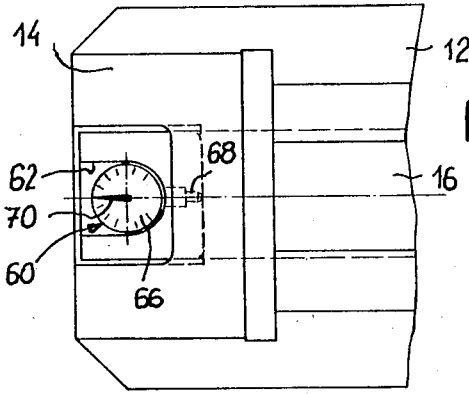
FIG. 10 is a plan view of the stationary clamping jaw showing the pressure sensitive device according to FIG. 8.

A second alternative construction for a float-mounting of the tie element 16 is shown in FIGS. 6 and 7. The gaps formed between the bottom face of the base section 20 of tie element 12 and the adjacent upper face of the base 12 on the one hand and between both pairs of adjacent side faces of both sections on the other hand are filled with an elastically deformable sealing compound as silicone caoutchouc which adheres at the metal faces. No mechanical mounting means are necessary. The elastic filling prevents that scobs can come into the gaps. In order to control the clamping force a commercially available load cell 60 is inserted into a recess of the front leg portion 18 of the tie element 16 as shown in FIGS. 8 and 10. The load cell forms a clamping force sensing device having a movable sensing pin 68 which projects from the front leg portion 18 and abuts against the inner wall 46 of the stationary clamping jaw 14. Below a window 62 provided in an upper wall 64 of the stationary clamping jaw 14 a disc 66 having a scale of the load cell 60 is arranged and an indicating pointer 70 above the disc 66 indicates the clamping force. During the clamping operation the front leg portion 18 swings to the left and at the same time is displaced to the right. Therefore, the space between the end face 42 and the inner face 46 in the area of the sensing pin 68 becomes smaller. This change is detected and indicated by the pointer 70.

Figure 9:
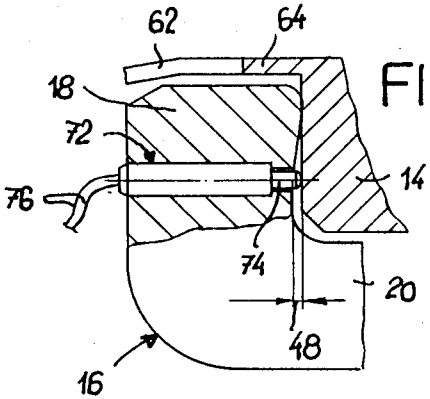
FIG. 9 is a longitudinal section of a tie element having an electrical switch.

According to FIG. 9 an electrical switch 72 having an axially projecting movable pin 74 is inserted into a longitudinal bore of the front leg portion 18. During clamping the pin 74 is moved axially into a housing of the switch 72 and closes the switch 72 whereby an electrical circuit 76 for starting a working machine is closed. This switch represents a safety means, because the working machine cannot be started if the workpiece is not clamped with sufficient clamping force by the vise.

Figure 11:
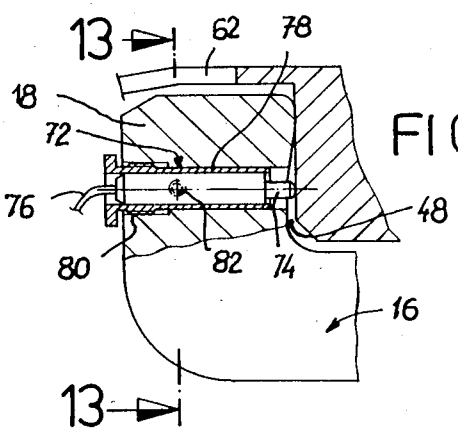
FIG. 11 is a longitudinal section of a tie element provided with an electrical switch the reaction point of which can be adjusted.

The switch 72 shown in FIG. 11 differs from the embodiment shown in FIG. 9 in that the switch 72 is inserted into a sleeve 78 displaceably mounted in a bore 82 and provided with a ring 80 threaded at the outer periphery thereof. The ring 80 is threadable in a thread portion of the bore 82. By rotating the sleeve 78 the switch 72 is axially displaced. Thereby the activating force level of the switch can be adjusted. A fastening screw 82 secures the sleeve 78 in a predetermined position.

Figure 12:
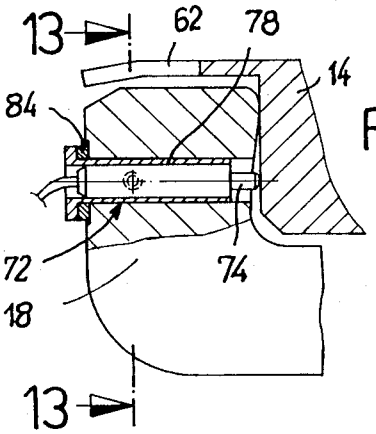
FIG. 12 is a longitudinal section similar to FIG. 11, showing an alternative adjustment device.

According to FIG. 12 the sleeve 78 as a whole is in thread engagement with a thread hole. The sleeve 78 has a flange which abuts against interchangeable distance rings 84 contacting a front face of the front leg portion 18.

In conclusion it should be clear from the foregoing that the main ideas of this invention resides in that the contacting means between the tie element 16 and the stationary clamping jaw 14 of the vise on the one hand and the supporting means of the tie element 16 on the other hand are different and separated from one another, that the tie element 16 is floatingly mounted on the base 12 for self-adjustment in such way that it can pivot about a vertical axis intersecting the centre of the contact area as seen in lateral direction, that the contact area is formed by nearly a contact line rather than by a contact surface and that a rolling line contact between the front leg portion 18 and the stationary clamping jaw 14 is achieved during the clamping operation thereby preventing any angularly displacement of the stationary clamping jaw 14. The contact area at the front leg portion 18 is at the highest point thereof and therefore on a level belonging to the upper half of the stationary clamping jaw 14. While forming a protruding convex nose at the front leg portion 18 is preferred, alternatively the end face 42 of this portion 18 can be arranged vertically and a similar nose can be provided at the opposite inner face of the stationary clamping jaw 14 to provide a rolling line contact therebetween.

I claim:

1. A vise comprising an elongated base, a stationary clamping jaw formed at one end of said base, a substantially U-shaped tie element having a base section, a front leg portion integrally formed therewith and a rear leg portion, the front leg portion pivotably arranged at the stationary clamping jaw about a crosswise axis at the upper end of the front leg portion, a threaded bore provided in the upper portion of the rear leg portion, a threaded spindle projecting through the threaded bore and abutting against a movable clamping jaw slidably mounted on said base for movement toward and away from said stationary clamping jaw, the crosswise axis for pivoting the front leg portion of the tie element arranged at an end face of the front leg portion, the end face facing the stationary clamping jaw, a substantial line-shaped contact area provided between the end face of the front leg portion and an adjacent inner face of the stationary clamping jaw and extending in crosswise direction substantially along the whole width of the front leg portion, and float mounting means mounting the tie element in a selfaligning manner for a swinging motion about a vertical axis intersecting the central point of the contact area at half of the width of the front leg portion.

2. A vise as claimed in claim 1, wherein at one of the contacting surfaces comprising the end face of the front leg portion and the adjacent inner face of the stationary clamping jaw a convex nose is formed, as seen in cross-section, and a gap is formed between the end face of the front leg portion and the inner face of the stationary clamping jaw, the gap extending from said nose to the base section of the tie element.

3. A vise as claimed in claim 2, wherein the inner width of the gap increases continuously in downward direction .

4. A vise as claimed in claim 2, wherein the nose is provided at the front leg portion and connects continuously an upper face of the front leg portion with the end face thereof, and wherein the end face and the adjacent inner face are formed by planar surfaces forming an acute angle therebetween.

5. A vise as claimed in claim 1, wherein said float mounting means are formed by portions of resilient material connecting the tie element to at least one of the base and the stationary clamping member.

6. A vise as claimed in claim 1, wherein a pair of laterally aligned spring-loaded bodies are mounted in one of the elements comprising the clamping jaw, and the front leg portion of the tie element and the bodies project laterally into recesses formed in the other one of the elements.

7. A vise as claimed in claim 1, wherein a pair of laterally aligned pins extend between the front leg portion and the stationary clamping jaw, and wherein the pins are mounted in sleeves consisting of elastic material.

8. A vise as claimed in claim 1, wherein at least one of the gaps formed between the tie element and the base and between the front leg portion and the stationary clamping jaw is completely filled with a resilient deformable material, which adheres at opposed side faces confining said gaps.

9. A vise comprising an elongated base, a stationary clamping jaw formed at one end of said base, a substantially U-shaped tie element having a base section, a front leg portion integrally formed therewith and a rear leg portion, the front leg portion pivotably arranged at the stationary clamping jaw about a crosswise axis at the upper end of the front leg portion, a threaded bore provided in the upper portion of the rear leg portion, a threaded spindle projecting through the threaded bore and abutting against a movable clamping jaw slidably mounted on said base for movement toward and away from said stationary clamping jaw, a gap formed between the end face of the front leg portion and the inner face of the stationary clamping jaw a clamping force sensing device arranged in the front leg portion and provided with a movable sensing element, the sensing element projecting through the gap and abutting against the inner face of the stationary clamping jaw.

10. A vise as claimed in claim 9, wherein the sensing device comprises a rotatable indicator.

11. A vise as claimed in claim 10, wherein the stationary clamping jaw comprises an upper wall overlapping the front leg portion and a window is provided in the upper wall above the indicator.

12. A vise as claimed in claim 9, wherein the sensing device comprises an electrical switch which becomes closed to start an electrical machine when a predetermined value of the clamping force has been reached.

13. A vise as claimed in claim 12, wherein the switch is displaceably arranged for adjustment in a recess in a direction parallel with the clamping force and wherein locking means are provided to hold the switch in each predetermined position.

* * * * *